United States Patent [19]

Dürr

[11] Patent Number: 4,630,512

[45] Date of Patent: Dec. 23, 1986

[54] ADJUSTABLE MOTOR-OPERATED SCREW DRIVING DEVICE

[75] Inventor: Paul Dürr, Ulisbach, Switzerland

[73] Assignee: Hilti Aktiengesellschaft

[21] Appl. No.: 771,975

[22] Filed: Sep. 3, 1985

[30] Foreign Application Priority Data

Sep. 3, 1984 [DE] Fed. Rep. of Germany ..... 3432382

[51] Int. Cl.[4] ..... B25B 23/157

[52] U.S. Cl. ..... 81/475; 81/429

[58] Field of Search ..... 81/429, 475

[56] References Cited

U.S. PATENT DOCUMENTS

| | | | |
|---|---|---|---|
| 2,796,161 | 6/1957 | Graybill | 81/475 X |
| 3,454,059 | 7/1969 | Sindelar | 81/429 |
| 3,527,273 | 9/1970 | Falter | 81/429 |
| 3,869,942 | 3/1975 | De Caro | 81/429 X |
| 3,934,629 | 1/1976 | Boman | 81/429 |
| 3,943,800 | 3/1976 | Lesner | 81/475 |

FOREIGN PATENT DOCUMENTS

| | | | |
|---|---|---|---|
| 1208212 | 10/1970 | United Kingdom | 81/475 |

*Primary Examiner*—Frederick R. Schmidt
*Assistant Examiner*—Debra S. Meislin
*Attorney, Agent, or Firm*—Toren, McGeady, Stanger, Goldberg & Kiel

[57] ABSTRACT

In a motor-driven screw driving device, a drive unit and a drive member are located within a housing and are interconnected by a torque-limiting coupling. The coupling is adjustable by changing the force applied to a spring element. The spring element is supported within a stop sleeve located within the housing and the stop sleeve is axially displaceable relative to the housing. A depth stop on the drive spindle is adjustable relative to the stop sleeve. An actuating sleeve accessible on the exterior of the screw driving device affords the adjustment of the stop sleeve and the depth stop. A connecting element is secured to the actuating sleeve and is in engagement with the depth stop so that the actuating sleeve and depth stop can be rotated as a unit. The connecting element is selectively engageable with the stop sleeve so that the actuating sleeve and stop sleeve can be rotated as a unit for adjusting the torque-limiting coupling.

3 Claims, 3 Drawing Figures

ADJUSTABLE MOTOR-OPERATED SCREW DRIVING DEVICE

BACKGROUND OF THE INVENTION

The invention is directed to a motor-operated screw driving device with an adjustable torque-limiting coupling positioned between a drive unit and a drive spindle for effecting the screw driving operation. A stop sleeve is mounted within and is axially displaceably adjustable relative to the housing of the device. An adjustable spring element is positioned within the stop sleeve for adjusting the torque-limiting coupling. Further, a depth stop is mounted on the stop sleeve and can be axially displaced along the sleeve. An actuating sleeve is connected to the depth stop so that the actuating sleeve and depth stop can be rotated as a unit for the axial displacement of the depth stop.

In known motor-operated screw driving devices an adjustable torque-limiting coupling is used as well as an adjustable depth stop. The torque-limiting coupling is adjusting by varying a tension force applied by a spring element located between a coupling part arranged for rotation with a drive spindle, and a power take-off part of a drive unit.

Accordingly, a stop sleeve or bush acting as an abutment for the spring element is axially displaceable relative to the device housing. A first actuating sleeve connected with the stop sleeve affords the adjusting procedure. Separate from the first actuating sleeve is a second actuating sleeve for adjusting the depth stop. By means of the second actuating sleeve, manually transmitted rotational movement is transmitted to the depth stop and it is axially displaced relative to the stop sleeve due to a threaded connection with the device on which the depth stop is positioned.

In this known arrangement there is the particular disadvantage that, with respect to the handling of the device, there is the possibility of confusing the actuating sleeves.

SUMMARY OF THE INVENTION

Therefore, the primary object of the present invention is to provide a simple actuating device capable of being operated in a problem-free manner where a screw driving device of the type described above affords adjustment of the torque-limiting coupling and the depth stop.

In accordance with the present invention, an actuating sleeve for the desired adjustment includes a connecting element affording a rigid connection with the stop sleeve so that the actuating sleeve and the stop sleeve can be rotated as a unit.

As a result, the actuating sleeve affords a double function in that in one position it can adjust the depth stop and in another position it can adjust the torque limiting coupling. Accordingly, a simple construction is afforded which facilitates the handling and adjustment of the screw driving device.

The actuating sleeve includes a pin-like connection member engageable in catch recesses in the front portion of the stop sleeve so that interengagement is provided between the actuating sleeve and the stop sleeve. The catch recess can be provided in the stop sleeve or in a supporting ring mounted on the stop sleeve.

Preferably, catch elements are provided on the actuating sleeve and on the stop sleeve for fixing the actuating sleeve in position relative to the stop sleeve where the two sleeves can be rotated as a unit. Further, by displacement of the catch elements into a spaced apart position it is possible to rotate the actuating sleeve relative to the stop sleeve.

The arrangement of the catch elements permits the user of the screw driving device to appreciate the position of the actuating sleeve for effecting the desired adjustments. Moreover, the catch elements prevent any accidental change in the position of the actuating sleeve which might occur during vibration of the device or because of other outside influences.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
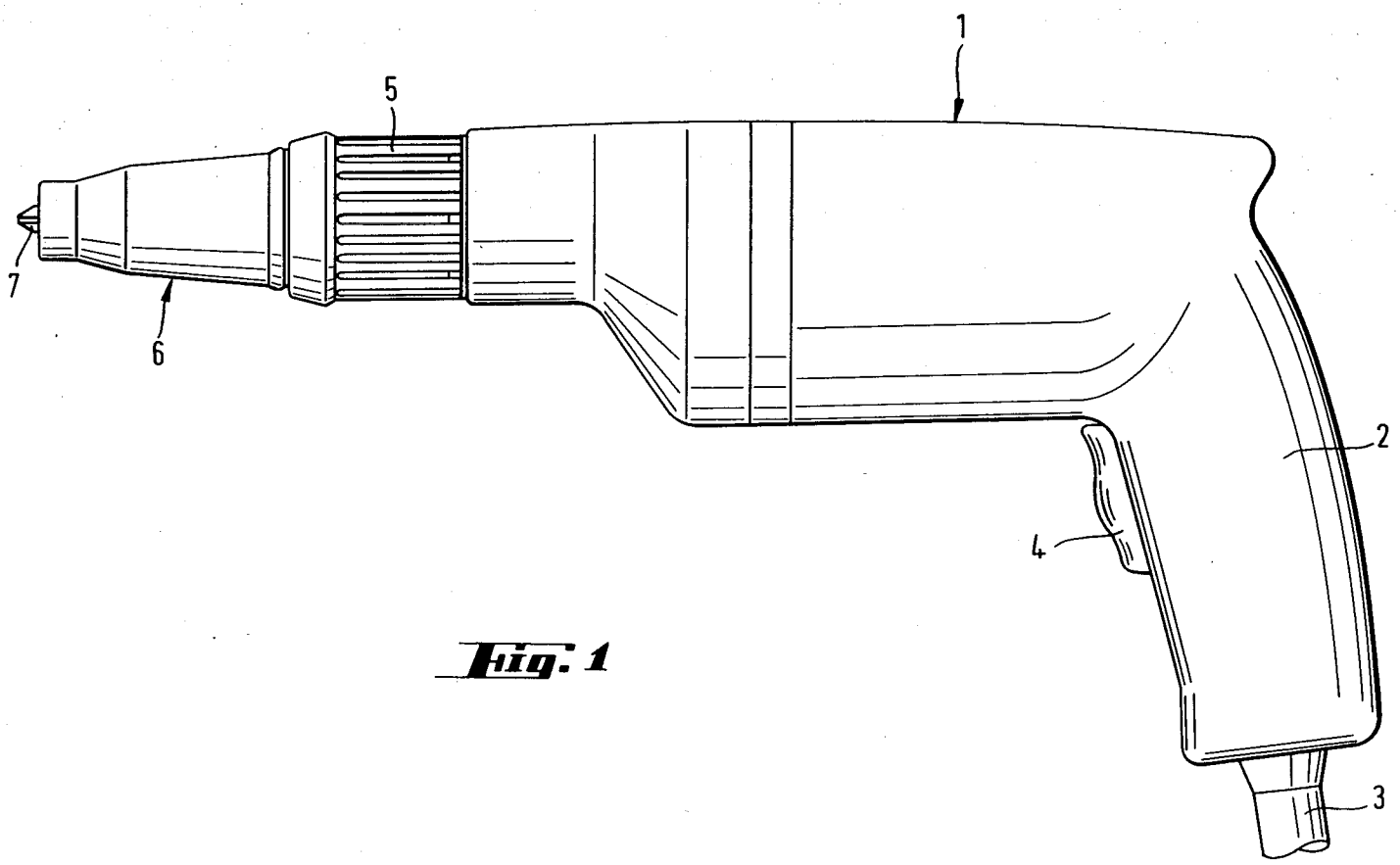
FIG. 1 is a side elevational view of a screw driving device embodying the present invention.

The screw driving device depicted in FIG. 1 has a housing 1 in the form of a hand operated tool. The device has a front end at the left and a rear end at the right and the various parts of the device have a similar front end and rear end orientation. A handle 2 is shown extending downwardly from the rear end of the housing 1 and a cable 3 extends into the lower end of the handle and serves as a current supply line. The screw driving device is operated by a trigger 4 for placing the device in the on or off condition. At the front end of the housing 1, an actuating sleeve 5 is positioned with a depth stop 6 projecting forwardly from the actuating sleeve. At the front end of the depth stop 6 there is a screw driving insert 7 extending forwardly out of the depth stop. The screw driving insert is a conventional member, accordingly, it is not described in further detail.

Figures 2, 3:
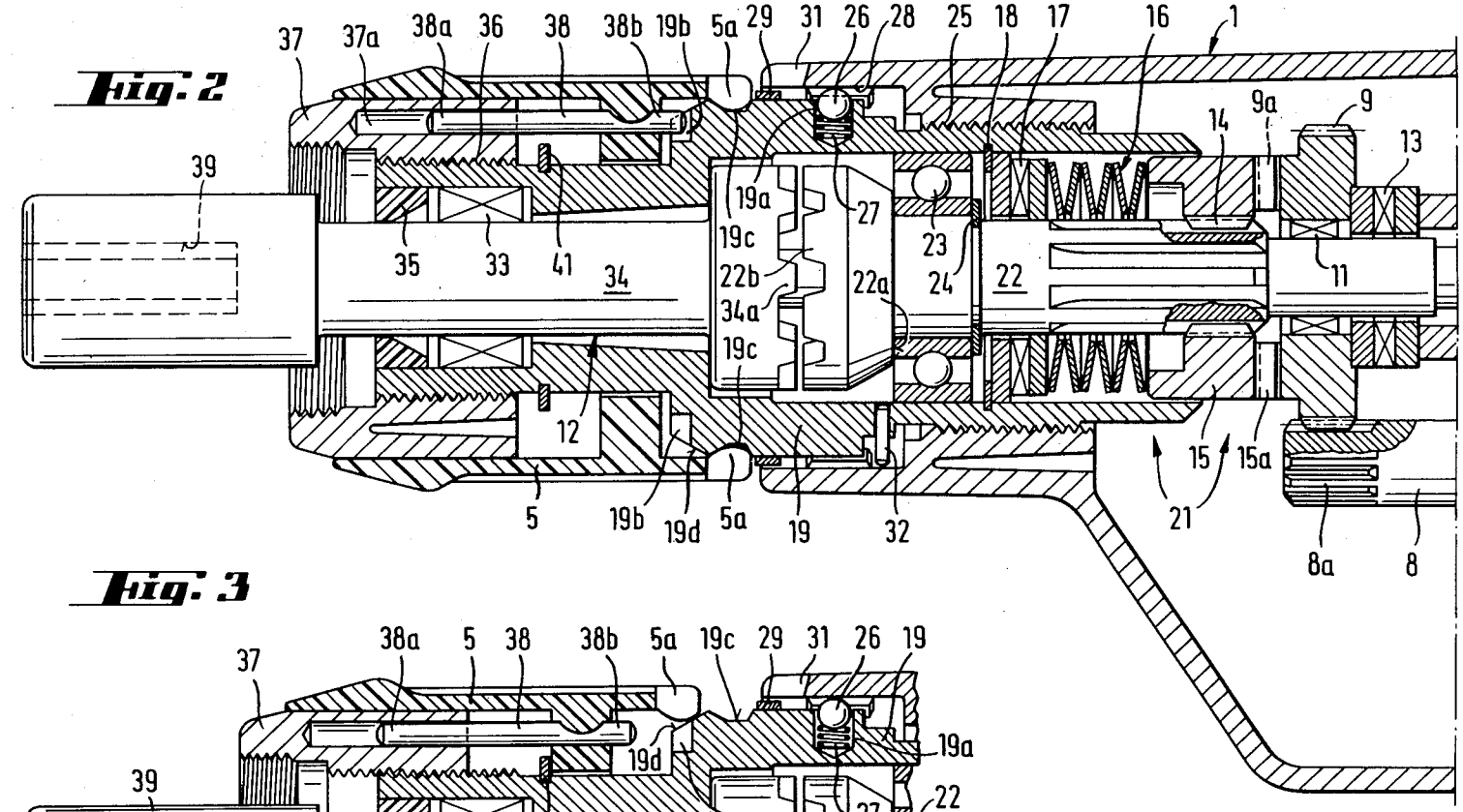
FIG. 2 is an enlarged partial axially extending sectional view through the front part of the screw driving device, as shown in FIG. 1, with the depth stop and the screw driving insert removed.
FIG. 3 is a partial sectional view of the section shown in FIG. 2 with the actuating sleeve displaced into another operating position.

In the right-hand or rear portion of FIG. 2 a drive shaft 8 from a motor, not shown, is illustrated. At its front end, the drive shaft 8 has a pinion **8*a* engageable with a toothed wheel 9 supported in a rotating bearing 11 on a drive spindle 12 axially divided into a rear spindle section 22 and a front spindle section 34. The drive spindle is freely rotatable. The toothed wheel 9 acts as a power take-off part from the drive motor. On the rear side of the toothed wheel 9 there is a roller bearing 13 in contact with the wheel. At its front side, the toothed wheel 9 has teeth 9*a* extending around the rear section 22 of the spindle. Immediately forward of the toothed wheel 9 is a disc-shaped coupling part 15 axially displaceably mounted on the rear section 22 of the drive spindle 12 and secured against relative rotation with the drive spindle by a splined connection 14 with the drive spindle. The coupling part 15 has teeth 15*a* for engagement with the teeth 9a on the wheel 9. Attention is directed to the applicant's application Ser. No. 771,976 filed Sept. 3, 1985 directed to the specific arrangement of the teeth 9a and 15a. The meshed interengagement of the teeth 15a on the coupling part 15 is effected with the teeth 9a on the front side of the wheel 9 by the biasing force of a spring element 16 made up of Belleville springs. The spring element 16 is supported at its front end by another roller bearing 17 which, in turn, bears against a securing ring 18 fitted into the inside surface of an axially extending stop sleeve 19. Stop sleeve 19 projects axially forwardly from the region of the coupling part 15 toward the front end of the screw driving device. In combination, the wheel 9, the coupling part 15 and the spring element 16 form a torque-limiting coupling 21**.

Securely fitted on the front part of the rear section 22 of the drive spindle 12 is a ball bearing 23 which is axially displaceable between the supporting ring 24 fitted in the rear section 22 and a shoulder 22a at the front side of the ball bearing. The ball bearing 23 is located just forward of the roller bearing 17. Ball bearing 23 serves as a rotational bearing for the rear section 22 of the drive spindle 12. Toward its rear end and on its radially outer surface, the stop sleeve 19 is connected with the housing 1 by a thread 25 so that the stop sleeve can be axially displaced relative to the housing for varying the biasing force afforded by the spring 16. Forwardly of the thread 25, a radial borehole 19a is located in the stop sleeve 19 and a catch ball 26 is positioned in the borehole and is biased radially outwardly by a spring 27 into engagement with axially extending grooves 28 formed in the radially inner surface of the housing 1. The grooves 28 extend in the circumferential direction around the inner surface of the housing 1. Due to the interengagement of the catch ball 26 in the grooves 28, rotation of the stop sleeve 19 relative to the housing can be effected only after the biasing action acting on the catch ball 26 is overcome.

Just forwardly of the borehole 19a, a graduated ring 29 is pressed on and encircles the outside surface of the stop sleeve 19. A viewing window 31 is formed in the housing 1 outwardly from the graduated ring 29 so that the adjusted torque stage of the device can be visually determined. The maximum and minimum adjustment of the torque is defined by a pin 32 extending radially outwardly from the stop sleeve 19. By overcoming the locking action of the catch ball 26, and rotating the stop sleeve 19 relative to the housing 1, an adjustment of the torque can be attained.

A rotational bearing 33 for the front section 34 of the drive spindle 12 is located in the front region of the stop sleeve 19. In addition, a sealing ring 35 in contact with and encircling the surface of the front section 34 is located just ahead of the rotational bearing 33. A connection ring 37, part of the depth stop 6 not shown in FIGS. 2 and 3, is in threaded engagement by way of a thread 36 with the front end of the stop sleeve 19.

Actuating sleeve 5 is located radially outwardly from the front region of the stop sleeve 19 and its inner surface at its front end rests on the radially outer surface of the connection ring 37. Actuating sleeve 5 is formed of a plastics material and includes an axially elongated connecting element 38 in the form of a cast pin secured to the actuating sleeve. As can be seen in FIGS. 2 and 3 the connecting element 38 is mounted in a radially inwardly extending ring-like projection on the actuating sleeve. The connecting element projects forwardly and rearwardly of the ring-like projection. At its front end 38a the connecting element 38 is secured within an axially extending borehole 37a in the connection ring 37. The opposite rear end 38b of the connecting element, as shown in FIG. 2, extends into a catch recess 19b in the stop sleeve 19. A plurality of the catch recesses 19b are arranged around the outer surface of the stop sleeve 19 with the recesses facing toward the forward end of the stop sleeve. In the engaged position of the actuating sleeve 5 with the stop sleeve 19, the actuating sleeve is held in a groove 19c encircling the outer surface of the stop sleeve 19 just ahead of the graduated ring 29. An annular bead 5a is formed at the rear end of the actuating sleeve and the bead resiliently seats within the groove 19c in the engaged position of the actuating sleeve with the stop sleeve. The bead 5a is formed on the ends of resilient fingers formed in the actuating sleeve 5 so that the displacement of the bead 5a out of the groove 19c can be easily effected.

To operate the screw driving device, the screw driving insert 7, not shown in FIGS. 2 and 3, is inserted into a receiving bore 39 in the enlarged front end of the front section 34 of the drive spindle. Accordingly, the insert can rotate with the spindle. In the screw driving operation, which can be effected for driving or removing a screw, the front section 34 of the drive spindle 12 is displaced toward the rear section 22 so that interengagement of the claw tooth collars or rings 34a and 22b is effected, whereby the drive spindle forms a unit arranged to be driven via the torque limiting coupling 21.

Torque is introduced from the drive shaft 8 through the torque limiting coupling 21 to the drive spindle 12 and then to the screw driving insert 7. The torque transmitted through the torque limiting coupling 21 is adjusted by varying the axial position of the stop sleeve 19 relative to the housing. By this axial displacement the biasing force effected by the spring 16 on the coupling part 15 can be adjusted. The adjustment of the stop sleeve 19 is carried out by rotating the actuating sleeve 5. Due to the engagement of the connecting element 38 in one of the catch recesses 19b, manual rotation of the actuating sleeeve 5 rotates the stop sleeve 19 which is secured to the actuating sleeve so that it rotates with it. The axial displacement of the stop sleeve 19 is effected over the thread connection 25 with the housing 1.

To adjust the depth stop 6, it is necessary to displace the connecting ring 37 in the axial direction. To perform such axial displacement, the actuating sleeve 5 is pulled forwardly relative to the stop sleeve 19 until its radially inwardly directed ring-like projection contacts a stop ring 41 fitted into the radially outer surface of the stop sleeve 19. When the actuating sleeve is moved forwardly, the bead 5a is removed from the groove 19c and the rear end 38b of the connecting element 38 is moved out of the corresponding catch recess 19b. Compare FIG. 3 where the actuating sleeve is displaced forwardly out of engagement with the stop sleeve, with FIG. 2 where the actuating sleeve is in engagement with the stop sleeve. Due to the connection between the actuating sleeve 5 and the connection ring 37 afforded by the connecting element 38, as the actuating sleeve is rotated, the connecting ring is similarly rotated with the connecting ring moving axially relative to the stop sleeve due to the threaded connection 36. As the connection ring is rotated relative to the stop sleeve the catch ball 26 biased by the spring 27 into the corresponding groove 28 prevents the stop sleeve from rotating along with the connection ring. As mentioned above, FIG. 3 illustrates the displaced position of the actuating sleeve 5 relative to the stop sleeve 19 with the bead 5*a* displaced out of the groove 19*c* and bearing against a supporting flank 19*d* encircling the stop sleeve. The flank 19*d* face toward the front end of the screw driving device and the bead 5*a* is biased against the flank due to the arrangement of the actuating sleeve 5. Accordingly, movement of the actuating sleeve 5 into the position shown in FIG. 2 is possible only after displacing the bead over the flank 19*d* and to do this the operator of the device must provide a corresponding displacing force.

While specific embodiments of the invention have been shown and described in detail to illustrate the application of the inventive principles, it will be understood that the invention may be embodied otherwise without departing from such principles.

I claim:

1. Motor driven screw driving device comprising a housing having a front end and a rear end, a drive unit located within said housing adjacent the rear end thereof, a drive member located within the front end of said housing and extending from the front end of said housing for operative engagement with a screw for driving the screw into a receiving material, an adjustable torque limiting coupling operatively connecting said drive unit and said drive member, an axially elongated stop sleeve located within and extending in the front end-rear end direction of said housing and having a front end and a rear end, said stop sleeve is adjustably displaceable relative to the housing in the front end-rear end direction thereof, said torque limiting coupling includes an adjustable spring element located within said stop sleeve for adjusting said torque limiting coupling, said stop sleeve includes a depth stop adjacent the front end thereof, said depth stop being displaceable in the front end-rear end direction of said housing relative to said stop sleeve, an actuating sleeve connected to said depth stop for rotating said depth stop, said actuating sleeve being displaceable in the front end-rear end direction of said housing, wherein the improvement comprises that said actuating sleeve includes a connecting member for selective interengagement with said stop sleeve so that said actuating sleeve and said stop sleeve can be rotated as a unit.

2. Motor driven screw driving device, as set forth in claim 1, including means for securing said actuating sleeve and said stop sleeve in position so that said actuating sleeve and stop sleeve can be rotated as a unit and said means being axially displaceable so that said actuating sleeve can be rotated freely relative to said stop sleeve.

3. Motor driven screw driving device, as set forth in claim 2, wherein said means comprises a bead at the rear end of said actuating sleeve, an annular groove in said stop sleeve for receiving said bead, a plurality of catch recesses in said stop sleeve arranged to receive said connection element so that rotation of said actuating sleeve through said connecting element effects the rotation of said stop sleeve.

* * * * *